US005584646A

United States Patent [19]

Lewis et al.

[11] Patent Number: 5,584,646

[45] Date of Patent: Dec. 17, 1996

[54] HANDLING APPARATUS

[75] Inventors: Billy M. Lewis, Joplin, Mo.; Donald R. Smith, Quapaw, Okla.; Darin R. Miller, Joplin, Mo.

[73] Assignee: Wiseda Ltd., Baxter Springs, Kans.

[21] Appl. No.: 298,758

[22] Filed: Aug. 31, 1994

[51] Int. Cl.[6] ..... B66C 1/10

[52] U.S. Cl. ..... 414/738; 180/211; 280/766.1; 294/86.41; 901/15

[58] Field of Search ..... 414/738, 680, 414/687, 729; 901/15, 27, 28, 29; 294/86.41; 212/299, 261, 302, 901; 180/211, 216, 305, 306, 307; 280/763.1, 766.1

[56] References Cited

U.S. PATENT DOCUMENTS

| | | | |
|---|---|---|---|
| 3,263,822 | 8/1966 | Weinman | 212/901 X |
| 3,812,978 | 5/1974 | Roland et al. | 212/302 X |
| 3,922,930 | 12/1975 | Fletcher et al. | 74/665 B |
| 4,062,455 | 12/1977 | Flatau . | |
| 4,266,749 | 5/1981 | Lundstrom | 173/38 X |
| 4,283,165 | 8/1981 | Vertut | 414/733 |
| 4,431,366 | 2/1984 | Inaba et al. | 414/735 |
| 4,508,016 | 4/1985 | Weyer | 92/136 |
| 4,519,741 | 5/1985 | Testore | 414/738 |
| 4,629,391 | 12/1986 | Soyk et al. | 180/306 X |
| 4,650,392 | 3/1987 | Casteel | 414/680 |
| 4,676,713 | 6/1987 | Voelpel | 901/1 X |
| 4,698,775 | 10/1987 | Koch et al. | 364/478 |
| 4,872,363 | 10/1989 | Rosenthal | 901/28 X |
| 4,948,329 | 8/1990 | Fuse et al. | 901/15 X |
| 4,975,017 | 12/1990 | Brigden | 212/261 X |
| 4,993,912 | 2/1991 | King et al. | 901/1 X |
| 5,011,364 | 4/1991 | Anderson | 212/901 X |
| 5,035,445 | 7/1991 | Poulin | 280/763.1 |
| 5,259,721 | 11/1993 | Sato et al. | 212/901 X |

FOREIGN PATENT DOCUMENTS

| | | | |
|---|---|---|---|
| 146165 | 1/1962 | U.S.S.R. | 901/15 X |
| 1408666 | 10/1975 | United Kingdom | 901/15 X |

OTHER PUBLICATIONS

Three photographs of a developmental, self–propelled material manipulating apparatus built by another entity. Photograph #1 shows the front end of the apparatus, photograph #2 shows the back end of the apparatus, and photograph #3 provides a close–up view of an assembly used for rotating the boom of the manipulating apparatus.

*Primary Examiner*—Donald W. Underwood
*Attorney, Agent, or Firm*—Dougherty, Hessin, Beavers & Gilbert

[57] ABSTRACT

A mobile, self-propelled, multicapability apparatus useful for gripping, lifting, moving, rotating, and otherwise manipulating heavy articles. The inventive apparatus comprises: a base structure; a turret rotatably attached to the base structure; a first boom structure having a first end portion pivotably attached to the turret; a second boom structure having a first end portion pivotably connected to the distal end portion of the first boom structure; a first hydraulic assembly for pivoting the first boom structure with respect to the turret; a second hydraulic assembly for pivoting the second boom structure with respect to the first boom structure; a head assembly having a first end portion and a second end portion; and a third hydraulic assembly, connected to the second boom structure and to the first end portion of the head assembly, for pivoting the head assembly with respect to the distal end of the second boom structure. The head assembly used in the inventive apparatus preferably includes a hydraulic rotary actuator for rotating the second end portion of the head assembly with respect to the first end portion of the head assembly.

4 Claims, 11 Drawing Sheets

HANDLING APPARATUS

FIELD OF THE INVENTION

The present invention relates to devices for holding, lifting, lowering, and/or otherwise manipulating heavy articles.

BACKGROUND OF THE INVENTION

A need presently exists for a mobile, self-propelled, multi-capability apparatus which can be used for gripping, lifting, moving, rotating, and otherwise manipulating heavy articles. A need particularly exists for such an apparatus which: (a) can be used in mine maintenance shops for assembling, disassembling, and otherwise servicing offroad mining trucks and other mining equipment; (b) is highly maneuverable; (c) has a small footprint; and (d) has a very high degree of manipulative ability (i.e., the ability to retract, extend, move side to side, move up and down, rotate, etc.) at the grasping end thereof.

SUMMARY OF THE INVENTION

The present invention provides an apparatus for holding and manipulating heavy articles which satisfies the needs and incorporates the features discussed hereinabove.

In one aspect, the inventive apparatus comprises: a boom having a distal end portion; a head assembly having a first end portion and a second end portion, said first end portion being positioned adjacent to the distal end portion of the boom; and a pivoting means, connected to the boom and to the head assembly, for pivoting the head assembly in a first plane. The head assembly comprises a rotating means for rotating the second end portion of the head assembly with respect to the first end portion of the head assembly. Both the pivoting means and the rotating means are preferably hydraulically operated.

In another aspect, the apparatus of the present invention comprises: a boom having a distal end portion; a universal joint pivotably connected to the distal end portion of the boom; a head assembly having a first end portion and a second end portion, said first end portion of the head assembly being pivotably connected to the universal joint; a first pivoting means, connected to the boom and to the first end portion of the head assembly, for pivoting the head assembly with respect to the universal joint; and a second pivoting means, connected to the boom and to the first end portion of the head assembly, for pivoting the head assembly and the universal joint with respect to the distal end portion of the boom.

In yet another aspect, the present invention provides an apparatus for handling heavy articles, said apparatus comprising: a base structure; a turret rotatably attached to the base structure; a first boom structure having a first end portion pivotably attached to the turret, said first boom structure also having a distal end portion; a second boom structure having a first end portion pivotably connected to the distal end portion of the first boom structure; a first hydraulic operating means, connected to the turret and to the first boom structure, for pivoting the first boom structure with respect to the turret; and second hydraulic means, connected to the turret and to the second boom structure, for pivoting the second boom structure with respect to the first boom structure.

Further objects, features, and advantages of the present invention will be apparent to those skilled in the art upon reference to the accompanying drawings and upon reading the following description of the preferred embodiments.

DESCRIPTION OF THE PREFERRED EMBODIMENTS

Figure 1:
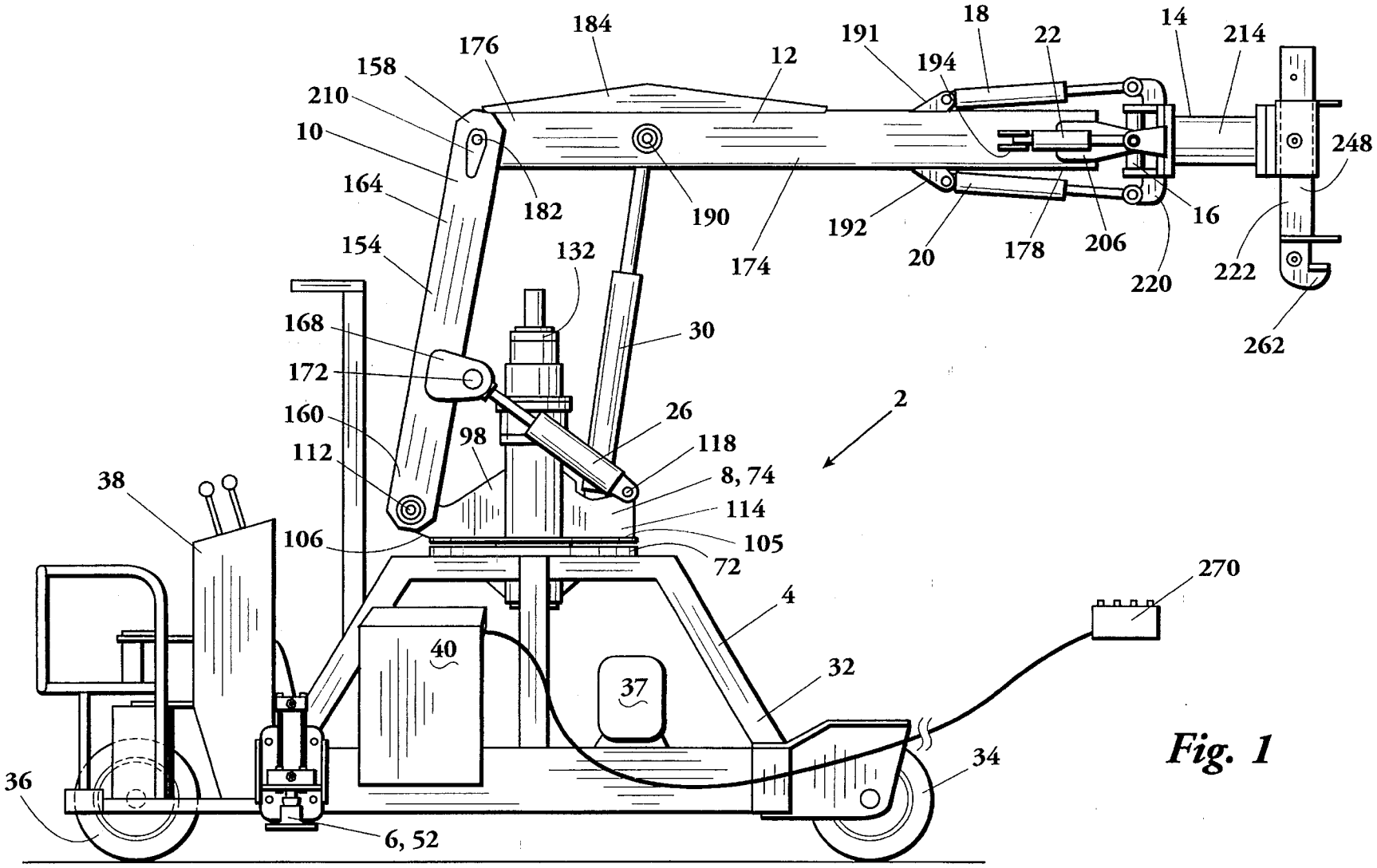
FIG. 1 provides an elevational side view of an embodiment 2 of the inventive, self-propelled handling apparatus.

An embodiment 2 of the inventive, self-propelled apparatus is depicted in FIGS. 1–15. Inventive apparatus 2 comprises: a mobile, self-propelled base structure 4; an outrigger assembly 6 installed on base structure 4; a turret assembly 8 rotatably mounted on the top of base structure 4; an upwardly extending boom structure 10 pivotably secured to turret assembly 8; a laterally extending boom structure 12 pivotably connected to the distal end of upwardly extending boom structure 10; a head assembly 14 associated with the distal end of laterally extending boom structure 12 by means of a universal joint 16; hydraulic cylinder assemblies 18 and 20 connected between laterally extending boom structure 12 and head assembly 14 for pivoting head assembly 14 and universal joint 16 upward and downward with respect to the distal end of boom structure 12; hydraulic cylinder assemblies 22 and 24 connected between laterally extending boom structure 12 and head assembly 14 for pivoting head assembly 14 from side to side with respect to universal joint 16; hydraulic cylinder assemblies 26 and 28 connected between upwardly extending boom structure 10 and turret assembly 8 for pivoting boom structure 10 with respect to turret assembly 8; and a hydraulic cylinder assembly 30 connected between laterally extending boom structure 12 and turret assembly 8 for pivoting laterally extending boom structure 12 with respect to upwardly extending boom structure 10.

Mobile, self-propelled base structure 4 comprises: a base frame 32; two front wheels 34 rotatably mounted on the front end of frame 32; a rear wheel 36 rotatably mounted to the rear of frame 32; a motor and hydraulic power assembly 37 mounted on frame 32 for operating the various hydraulic systems and assemblies used in inventive apparatus 2; a primary control station 38 mounted on the rear of base frame 32; and a handling system control station 40 mounted on the side of base frame 32. Primary control station 38 preferably includes operator controls for driving and steering inventive apparatus 2 and for operating outrigger assembly 6. Handling system control station 40, on the other hand, preferably includes operator controls for operating boom structures 10 and 12 and for operating head assembly 14.

Although generally any type of driving system can be used, base structure 4 is preferably propelled by means of a conventional hydraulic motor installed in the hub of rear wheel 36. As will also be understood by those skilled in the art, the system used for steering inventive apparatus 2 can be, for example, a conventional hydraulically operated chain and gear system providing rotation of the rear wheel 36 steering kingpin responsive to cylinder travel.

Outrigger assembly 6 comprises: an exterior elongate member 42 secured across the rear of base frame 32, said elongate member 42 having a passageway 44 extending longitudinally therethrough; an interior elongate member 46 reciprocatingly positioned in one end 47 of passageway 44, said interior elongate member 46 having a passageway 48 extending longitudinally therethrough and said elongate member 46 having an exterior shape corresponding to the interior shape of elongate member 42; an end plate 50 secured over the distal end of interior member 46; a hydraulic foot assembly 52 attached to the exterior of plate 50; a bracket assembly 54 attached by means of bolts 56 to an attachment block 58 secured in exterior member passageway 44; and a double acting hydraulic cylinder assembly 60 positioned in the passageway 48 of interior member 46 and having a first end 62 pivotably connected to bracket assembly 54 and a second end 64 pivotably connected to the interior side of plate 50. Outrigger assembly 6 further comprises an identical reciprocating assembly (i.e., an assembly including an interior elongate member 46, an interior member end plate 50, a hydraulic foot assembly 52, and a double acting hydraulic cylinder assembly 60) operably installed in the other end of exterior elongate member 42.

Although generally any type of mechanical or hydraulic foot assembly can be used in inventive apparatus 2, each foot assembly 52 is preferably a hydraulic assembly comprising: a hydraulic cylinder assembly 66 having a piston reciprocatingly received therein; a ball joint 68 attached to the lower end of the piston; and a foot member 70 pivotably mounted on the bottom of the foot assembly by means of ball joint 68.

As will be understood by those skilled in the art, before using inventive apparatus 2 for holding, lifting, and/or otherwise manipulating a heavy article, outrigger assembly 6 will preferably be engaged by (a) operating hydraulic cylinder assemblies 60 such that foot assemblies 52 are moved outwardly away from base frame 32 and then (b) operating hydraulic cylinder assemblies 66 such that feet 70 are lowered into contact with the ground. Likewise, when the holding, lifting, and/or manipulating operation is completed and it is desired to move inventive apparatus 2 to another location, outrigger assembly 6 will preferably first be disengaged by (a) operating hydraulic cylinder assemblies 66 such that feet 70 are raised out of contact with the ground surface and then (b) operating hydraulic cylinder assemblies 60 such that the hydraulic foot assemblies 52 move inward and are thereby positioned adjacent to the ends of outrigger member 42.

Turret assembly 8 comprises (a) a stationary base assembly 72 which is attached in fixed position to the top of base frame 32 and (b) a rotatable upper assembly 74 which is rotatably positioned on stationary base assembly 72.

Stationary base assembly 72 comprises: a slew pin holder 76; a slew pin 78; a keeper plate 80; a lower washer bearing 82; a first self-lube bushing 84; and a second self-lube bushing 85. Slew pin holder 76 includes: a vertically extending cylinder 86 having a cylindrical passageway 88 extending longitudinally therethrough; a radial plate 90 projecting outwardly from the top of cylinder 86; and a plurality a angular supports 92 connected to and extending between the bottom of radial plate 90 and the vertical exterior surface of cylinder 86. Radial plate 90 is secured to base frame 32 in fixed position by welding or by other suitable means. Slew pin 78 is held in and projects upwardly from passageway 88 of cylinder 86. Keeper plate 80 is welded or otherwise firmly secured to the lower end of slew pin 78. Keeper plate 80 is also firmly secured to the bottom end of cylinder 86 by means of screws 94 so that slew pin 78 is prevented from rotating in cylinder 86. Lower washer bearing 82 is positioned around slew pin 78 and is secured to the top of slew pin holder 76 by means of dowel pins 96. First bushing 84 is positioned around slew pin 78 at a point spaced above washer bearing 82. Second bushing 85 is positioned around the top end portion of slew pin 78.

The rotatable upper portion 74 of turret assembly 8 includes a turret structure 98 having an upper washer bearing 100 attached to the bottom thereof by means of capscrews 103. Turret structure 98 comprises: a vertically extending cylindrical portion 102 having a cylindrical passageway 104 extending longitudinally therethrough; a radial base plate 105 projecting outwardly from the lower end of cylindrical portion 102; and a pair of rearwardly projecting boom attachment brackets 106 attached to the exterior of cylindrical portion 102 and to the top of radial base plate 105. Each of boom attachment brackets 106 preferably includes a pair of prongs having apertures provided therein for pivotably attaching the legs of upwardly extending boom structure 10 to turret structure 98 by means of pins 112.

Turret structure 98 further comprises (a) a pair of forwardly projecting supports 114 attached to the exterior of cylindrical portion 102 and to the top of radial base plate 105 and (b) a forwardly projecting support 120 attached to the exterior of cylindrical portion 102 and to the top of radial base plate 105. Forwardly projecting supports 114 have tubular bosses 116 attached thereto for pivotably securing the lower ends of hydraulic assemblies 26 and 28 to turret structure 98 using pins 118. Forwardly projecting support 120 has a tubular boss 122 attached thereto for pivotably securing the lower end of hydraulic cylinder assembly 30 to turret structure 98 using a pin.

Upper washer bearing 100 and the passageway 104 of turret structure cylindrical portion 102 are sized for receiving slew pin 78 such that turret structure 98 is allowed to rotate about slew pin 78. Passageway 104 includes an enlarged bore portion 126 at the lower end thereof for containing first bushing 84. Passageway 104 also includes an inwardly projecting radial shoulder 128 near the upper end thereof for containing second bushing 85. Additionally, a lubrication passage and grease zerk 130 are provided in turret structure 98 for lubricating washer bearings 82 and 100.

Rotatably upper portion 74 of turret assembly 8 also includes a drive assembly 132 comprising: a hydraulic motor 134; a hydraulic brake 136 operably associated with motor 134; a gear reducer 138 operably associated with motor 134 and brake 136; and a drive shaft 139 projecting from gear reducer 138 and having splines 140 formed thereon.

Figure 9:
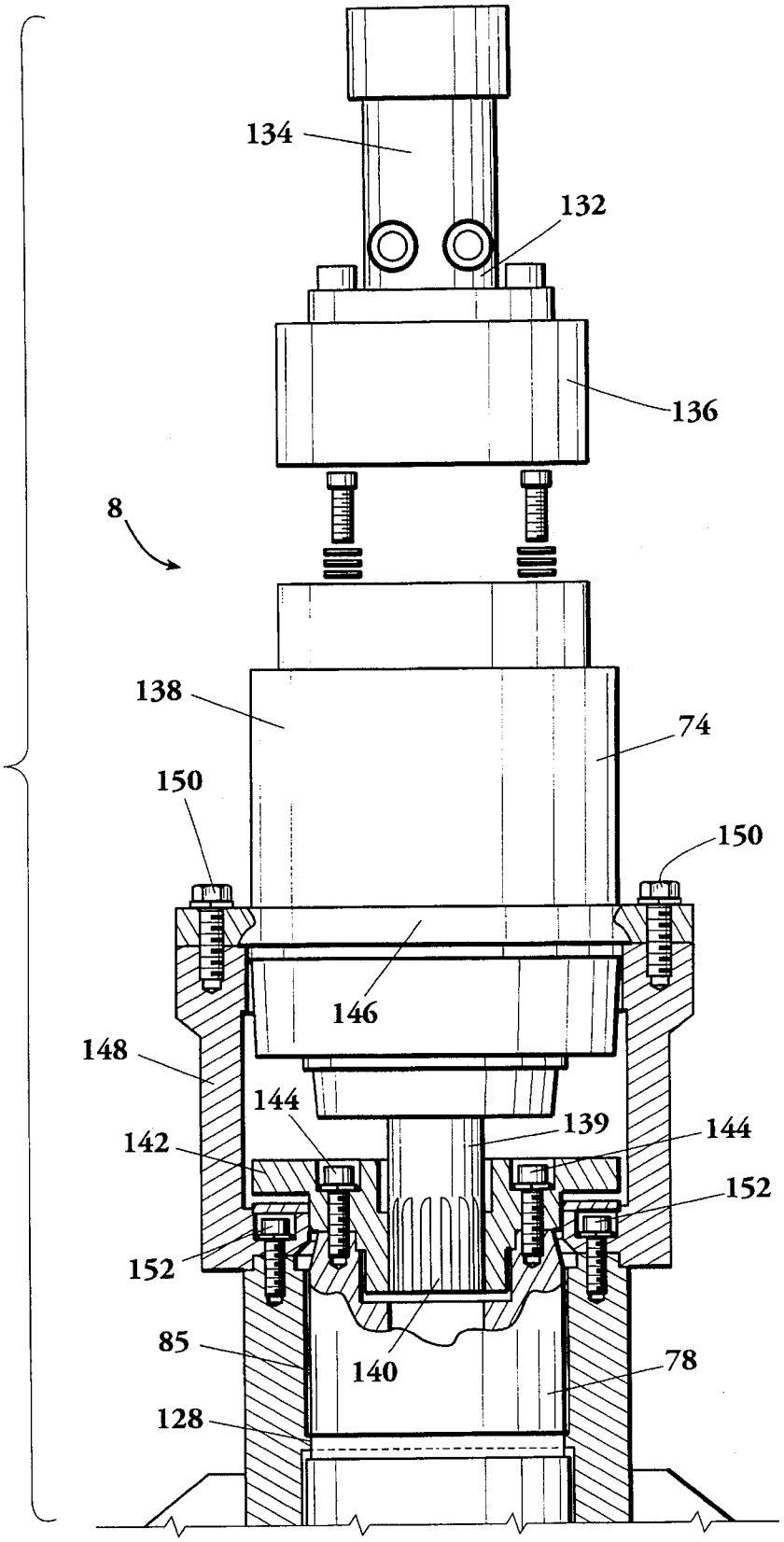
FIG. 9 provides a partially cutaway, partially exploded, elevational side view of the upper portion of turret assembly 8.
Figure 10:
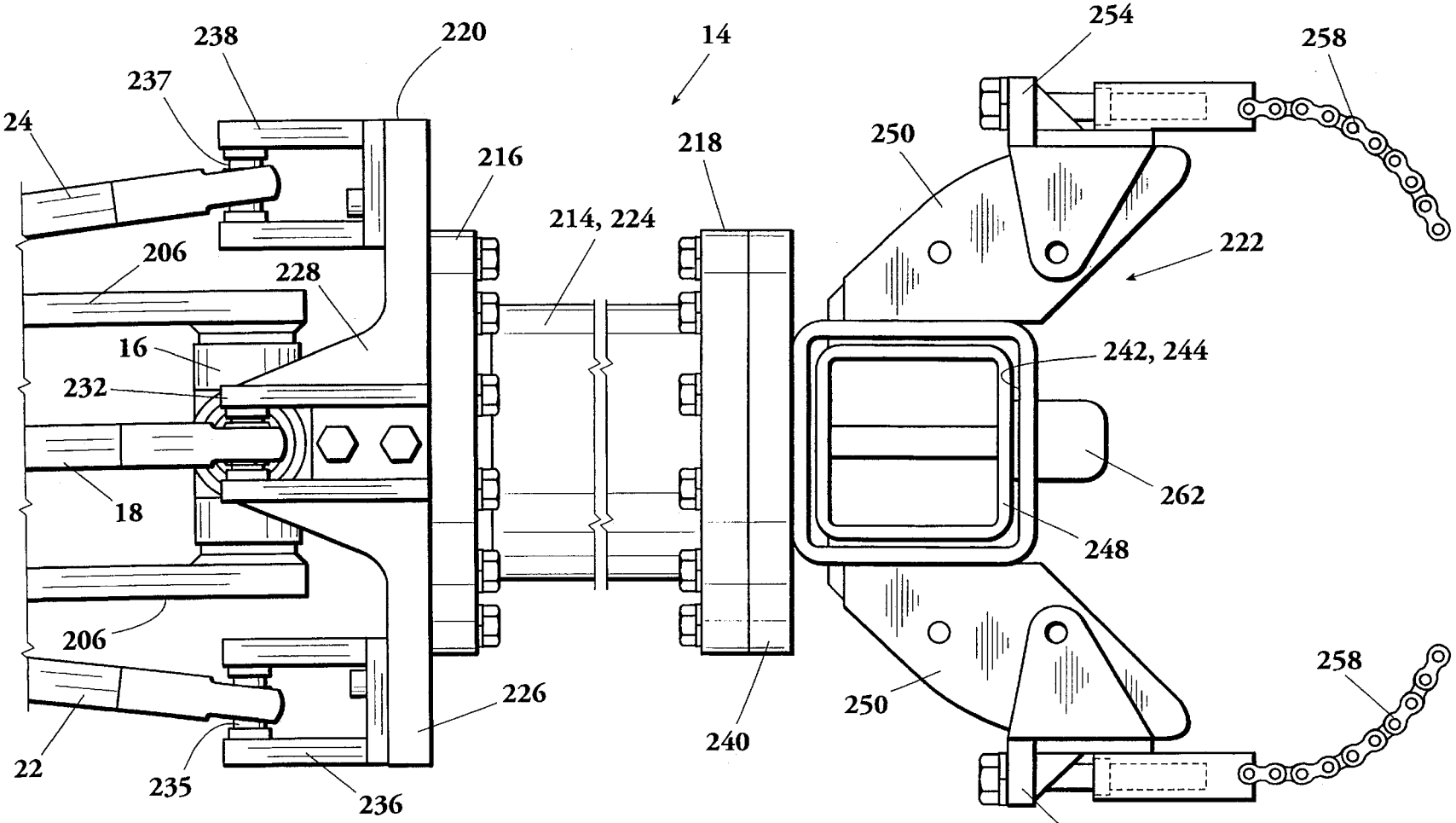
FIG. 10 provides a top view of head assembly 14.

Drive assembly 132 is connected to turret structure 98 and to the top of slew pin 78 such that assembly 132 drives the rotation of turret structure 98 about slew pin 78. As shown in FIG. 9, drive shaft 139 is securely attached to the upper end of slew pin 78 by means of a spline coupling 142 and capscrews 144. The housing of gear reducer 138, on the other hand, has a shoulder 146 provided on the exterior thereof which is securely attached, by means of an adapter 148, capscrews 150, and capscrews 152, to the upper end of the cylindrical portion 102 of turret structure 98.

Splined coupling 142 has a splined passageway extending therethrough which mates with splined drive shaft 139 so that splined coupling 142 prevents drive shaft 139 from rotating with respect to slew pin 78. Adapter 148, however, has an opening in the lower end thereof through which the lower portion of splined coupling 142 extends such that turret structure 98, adapter 148, and drive assembly 132 (except, that is, for drive shaft 139) are free to rotate with respect to slew pin 78 when drive assembly 132 is operated.

Upwardly extending boom structure 10 is preferably an A-frame type structure comprising a first leg 154 and a second leg 156. Each of legs 154 and 156 includes: an upper end portion 158; a lower end portion 160; and an elongate central portion 164 which extends downwardly and outwardly from upper portion 158 to lower portion 160. The lower end portions 160 of legs 154 and 156 are pivotably connected to turret structure 98 by placing lower end portions 160 in boom brackets 106 and inserting pins 112 through apertures provided in legs 154 and 156 and in brackets 106.

As indicated in FIG. 1, each of boom legs 154 and 156 preferably has a pair of forwardly projecting brackets 168 attached thereto. Brackets 168 have apertures provided therein for pivotably attaching the rod ends of hydraulic cylinder assemblies 26 and 28 to legs 154 and 156 using pins 172.

Laterally extending boom structure 12 includes an elongate boom arm 174 having: a substantially rectangular cross-section; a first end 176; a distal end 178; a horizontal aperture extending laterally through the first end 176 for pivotably connecting end 176 between the upper ends 158 of the boom legs 154 and 156 using a pin structure 182; a structural support 184 attached to the top of boom arm 174 adjacent the first end 176 thereof; an aperture provided in the bottom of boom arm 174 for receiving the rod end of hydraulic cylinder assembly 30; apertures provided through the side walls of boom arm 174 for pivotably connecting the rod end of hydraulic cylinder assembly 30 to boom arm 174 using a pin 190; double pronged brackets 191, 192, 194, and 196 attached to the top, bottom, and sides of boom arm 174 and having apertures provided therein for pivotably securing the cylinder ends of hydraulic cylinder assemblies 18, 20, 22, and 24 to boom arm 174 by means of pins 198, 200, 202, and 204; and bracket members 206 projecting from the distal end 178 of boom arm 174 and having apertures provided therein for pivotably connecting universal joint 16 to the distal end of boom arm 174 using U-joint pins 208.

The pin structure 182 used for pivotably connecting boom arm 174 to upwardly extending boom structure 10 is preferably comprised of a pin having a keeper plate 210 attached to the end thereof. Keeper plate 210 will preferably have an aperture provided therein for securing plate 210 to the side of boom structure leg 154 using a capscrew or other suitable means.

Head assembly 14 comprises: a rotary actuator 214 having a rearward end 216 and a forward end 218; a head adapter 220 secured to the rearward end 216 of rotary actuator 214; and a handling tool 222 secured to the forward end 218 of rotary actuator 214. Rotary actuator 214 is preferably a helical, hydraulic, rotary actuator comprising, for example: a cylindrical housing 224 secured to rearward end 216; a cylindrical shaft attached to forward end 218 and rotatably positioned in housing 224, said shaft having helical threads formed around the exterior thereof; and a hydraulic piston which (a) is reciprocatably positioned in cylindrical housing 224 in a manner such that the piston is prevented from rotating in housing 224 and (b) has a helically threaded bore provided therein which is positioned around and threadedly mates with the internal cylindrical shaft. Thus, the forward end 218 of rotary actuator 214 can be selectively rotated with respect to the rearward end 216 of actuator 214 by applying hydraulic fluid to the rearward and forward ends of the hydraulic piston such that the piston reciprocates in housing 224.

Figure 2:
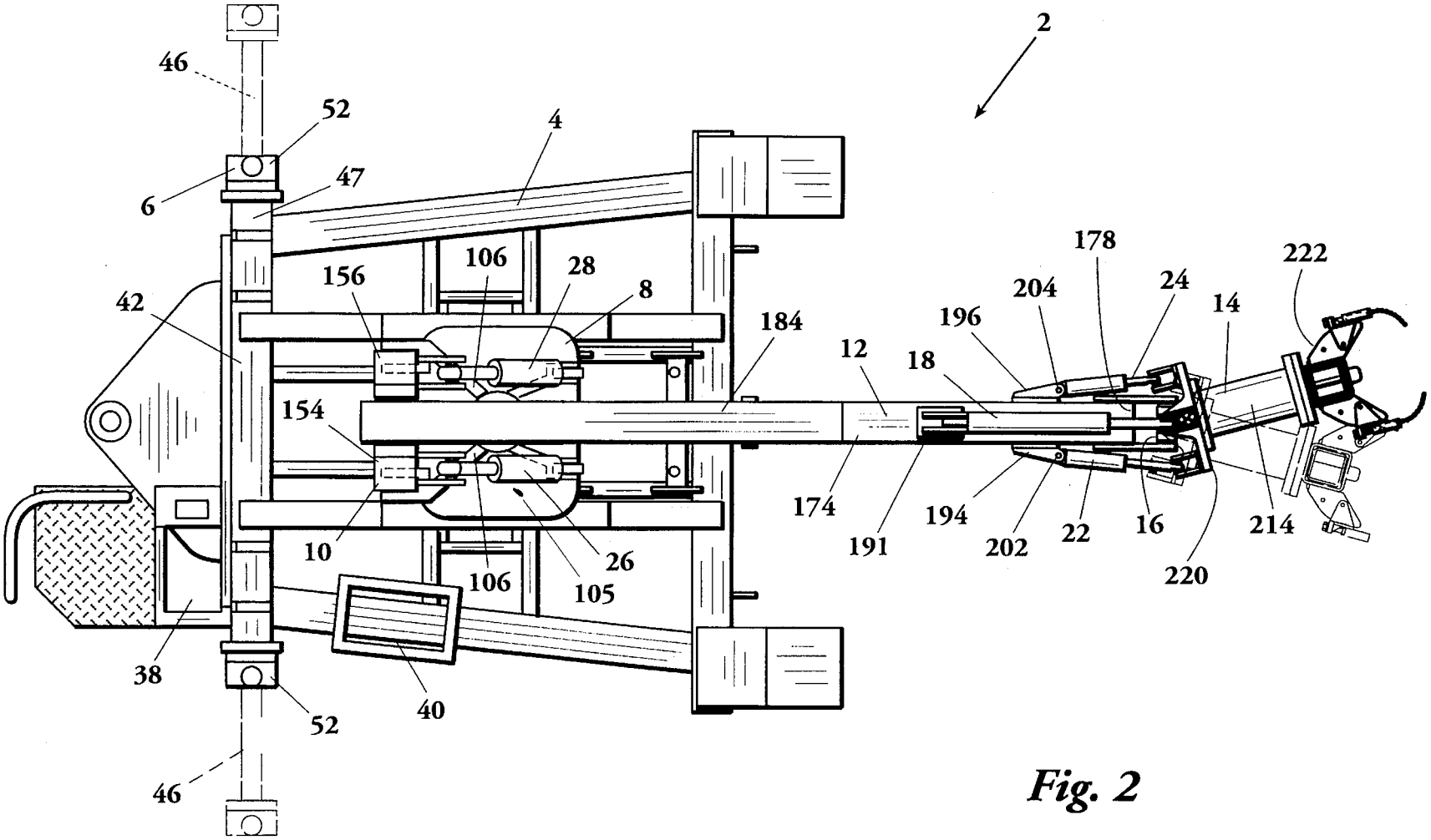
FIG. 2 provides a top view of inventive apparatus 2 and depicts the side to side pivoting operation of the apparatus' head assembly 14.
Figure 12:
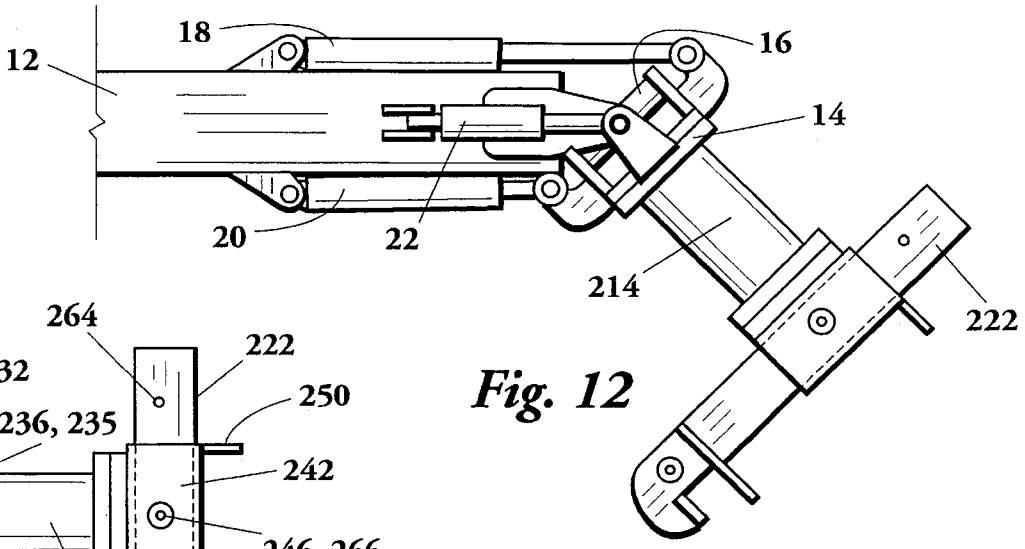
FIG. 12 corresponds to FIG. 11 and depicts the downward pivoting movement of head assembly 14 and universal joint 16 with respect to the distal end of boom structure 12.
Figure 13:
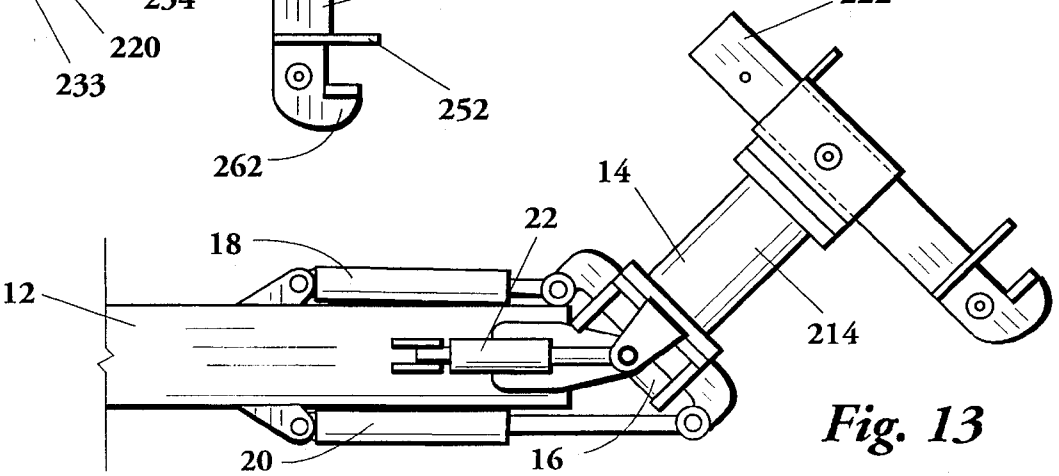
FIG. 13 corresponds to FIG. 11 and depicts the upward pivoting movement of head assembly 14 and universal joint 16 with respect to the distal end of boom structure 12.
Figure 11:
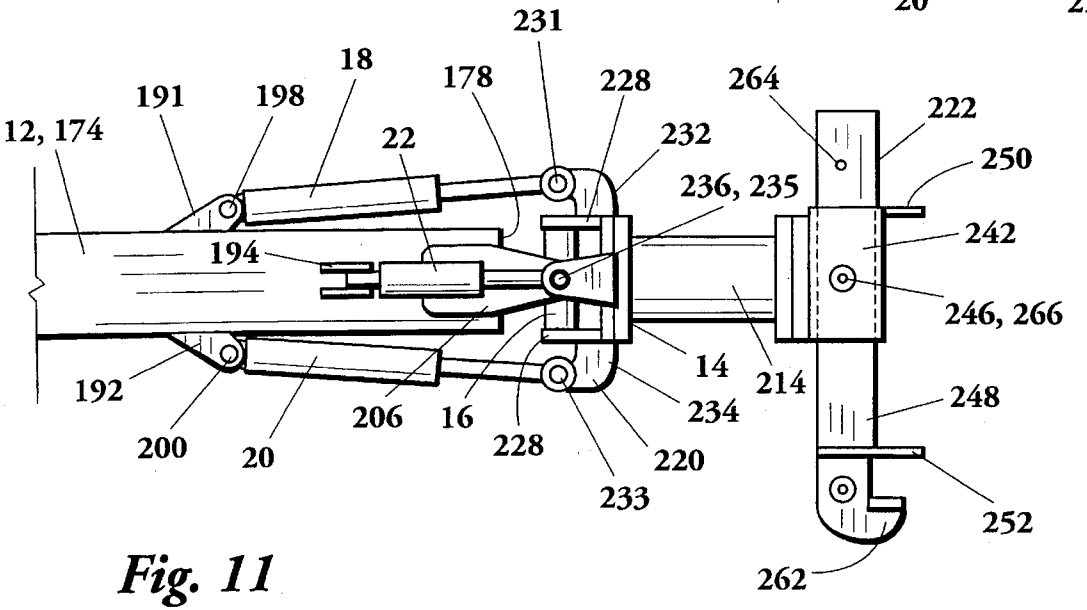
FIG. 11 provides an elevational side view of head assembly 14 associated with the distal end of laterally extending boom structure 12.
Figure 14:
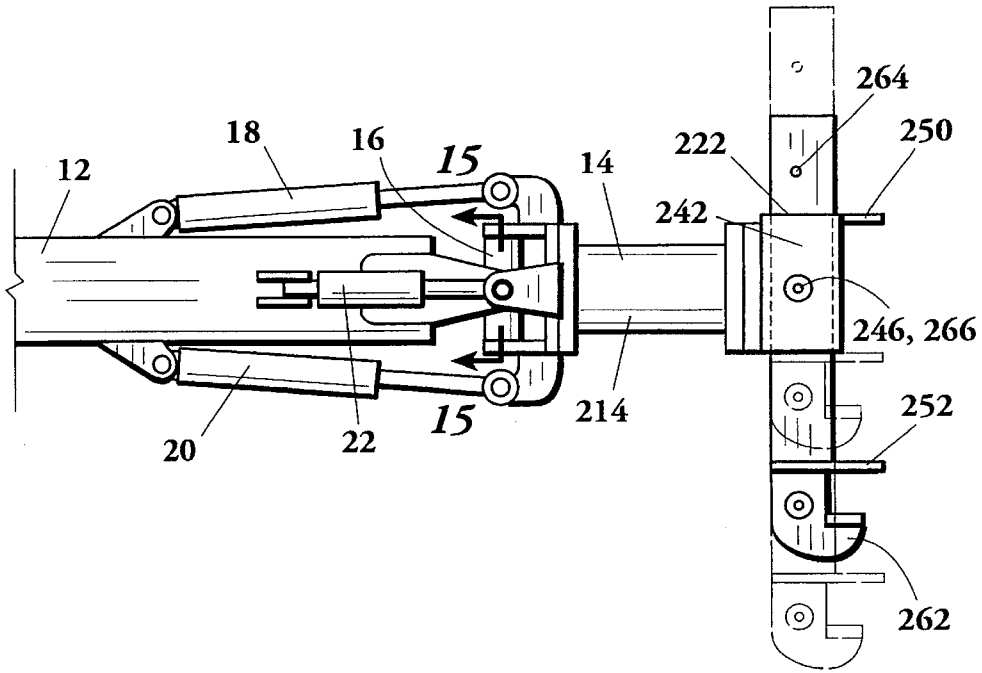
FIG. 14 corresponds to FIG. 11 and depicts various adjustment options for tool 222.
Figure 15:
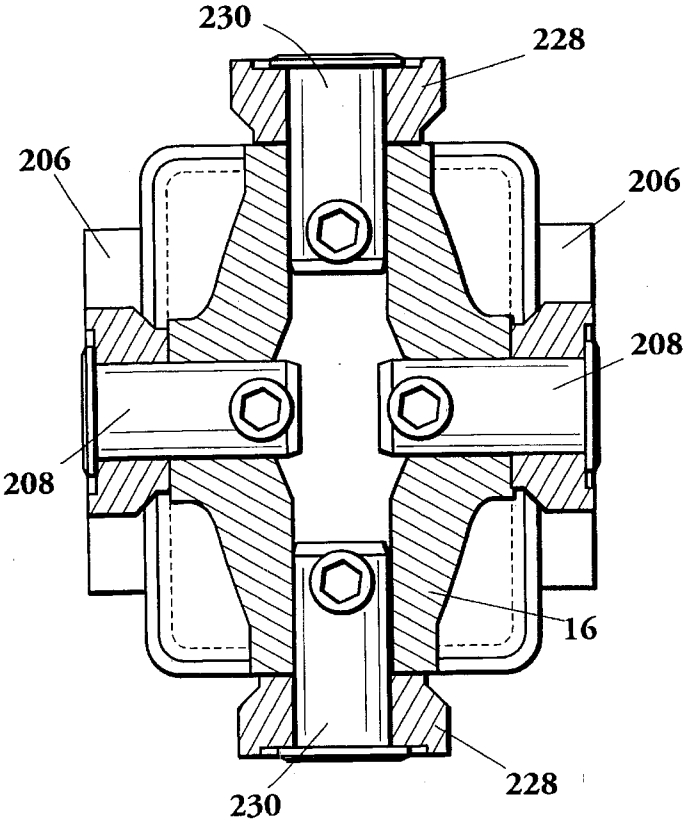
FIG. 15 provides a cross-sectional view of universal joint 16 as taken from perspective 15—15 shown in FIG. 14.

The head adapter 220 of head assembly 14 comprises: an adapter plate 226 attached to the rearward end 216 of rotary actuator 214; plates 228 extending rearwardly from the sides of adapter plate 226 and having apertures provided therein for pivotably attaching adapter 220 to universal joint 16 by means of U-joint pins 230; double pronged brackets 232 and 234 attached to plates 228 and having apertures provided therein for pivotably connecting the rod ends of hydraulic cylinder assemblies 18 and 20 to adapter 220 using pins 231 and 233; and double pronged brackets 236 and 238 extending rearwardly from adapter plate 226 and having apertures provided therein for pivotably connecting the rod ends of hydraulic cylinder assemblies 22 and 24 to adapter 220 using pins 235 and 237. As shown in FIGS. 11, 12, and 13, head assembly 14 and universal joint 16 can be pivoted upward and downward with respect to the distal end 178 of boom arm 174 by operating hydraulic cylinder assemblies 18 and 20. Further, as shown in FIG. 2, head assembly 14 can be pivoted from side to side on universal joint 16 by operating hydraulic cylinder assemblies 22 and 24. Moreover, hydraulic cylinder assemblies 18 and 20 and hydraulic cylinder assemblies 22 and 24 can be operated together to obtain generally any desired head assembly orientation.

Generally any type of equipment or material handling tool can be used in head assembly 14. The handling tool 222 depicted in the drawings comprises: a tool plate 240 secured to the forward end 218 of rotary actuator 214; a support member 242 attached to the forward side of tool plate 240, said support member 242 having a passageway 244 extending longitudinally therethrough and said member 242 having apertures 246 extending through the sides thereof; an elongate jaw member 248 having an exterior cross-sectional shape corresponding to the interior cross-sectional shape of support member 242 such that jaw member 248 is slidably positionable in support member 242; an upper pair of forwardly projecting tensioner attachment plates 250 connected to the sides of support member 242; a lower pair of forwardly projecting tensioner attachment plates 252 connected to the sides of jaw member 248; chain tensioners 254 connected to tensioner attachment plates 250; a substantially identical pair of chain tensioners connected to tensioner attachment plates 252; an upper gripping chain 258 connected between chain tensioners 254; and a substantially identical gripping chain connected between the lower pair of chain tensioners. Elongate jaw member 248 has a forwardly projecting lip 262 provided at the bottom thereof. Additionally, apertures 264 are provided along the length of jaw member 248. Apertures 264 correspond to the support member apertures such that, by aligning a desired pair of jaw member apertures 264 with the support member apertures and inserting a hitch pin 266 therein, the vertical position of jaw member 248 in support member 242 can be selectively adjusted.

Figure 4:
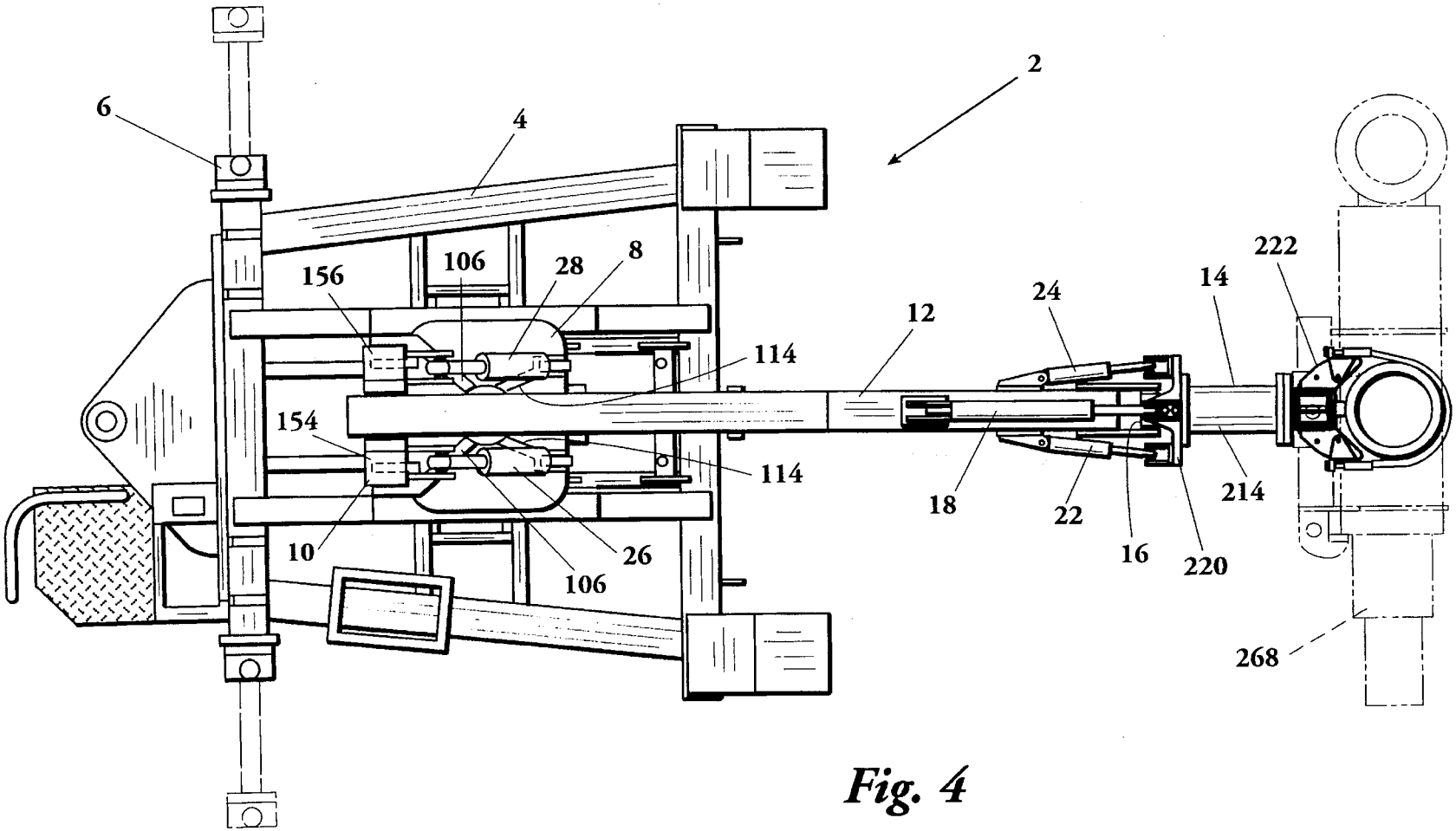
FIG. 4 provides a top view of inventive apparatus 2 and depicts the rotational operation of head assembly 14.

By way of example, the attachment of handing tool 222 to an item 268 is depicted in FIG. 4. As seen in FIG. 4, tool 222 is attached to item 268 by (a) positioning lip 262 against an exterior surface or edge provided on item 268 and then (b) tightly positioning the tool gripper chains around the exterior of item 268.

Figure 3:
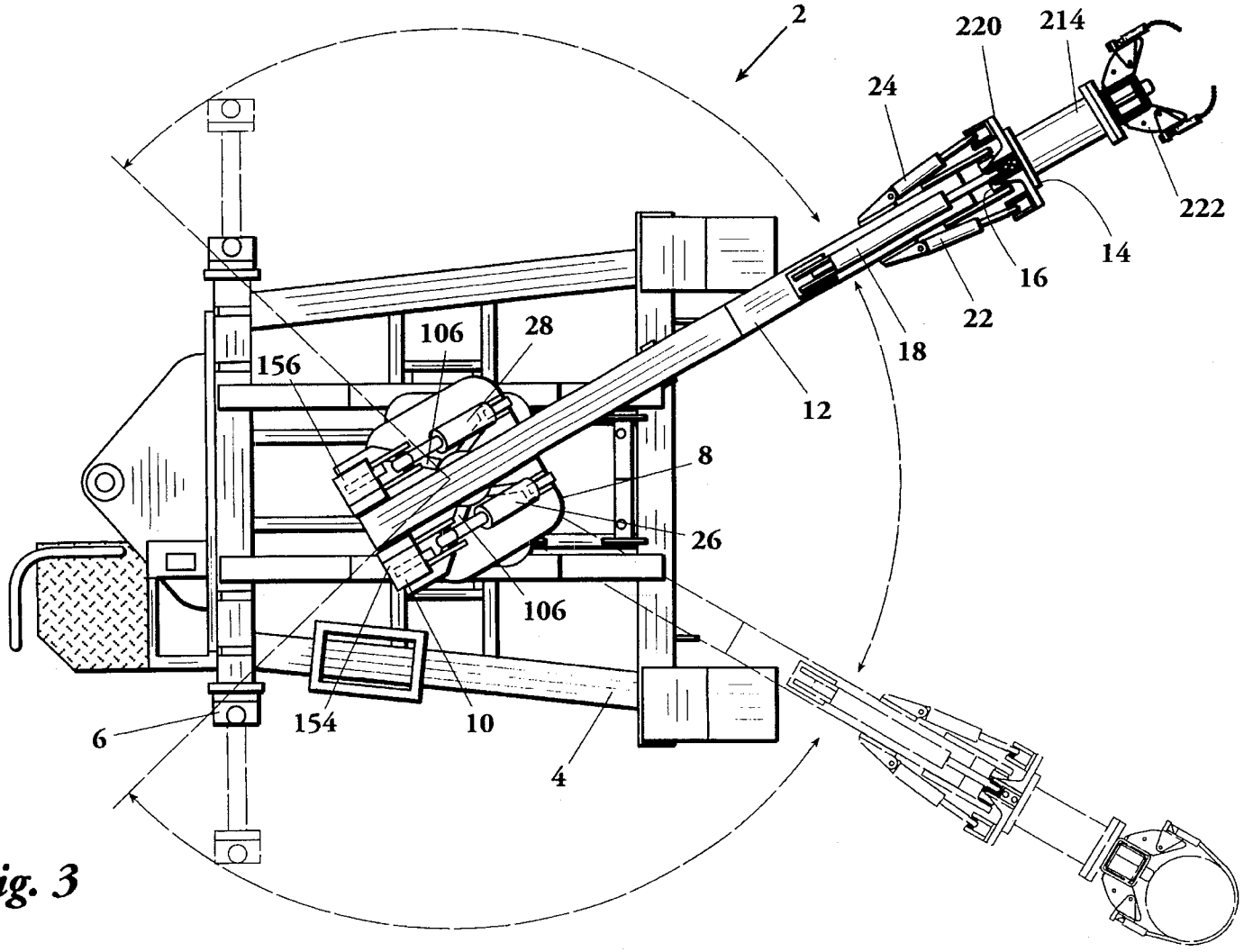
FIG. 3 provides a top view of inventive apparatus 2 and depicts the slew operation of the apparatus' turret assembly 8 for pivoting boom structures 10 and 12 about base structure 4.
Figure 5:
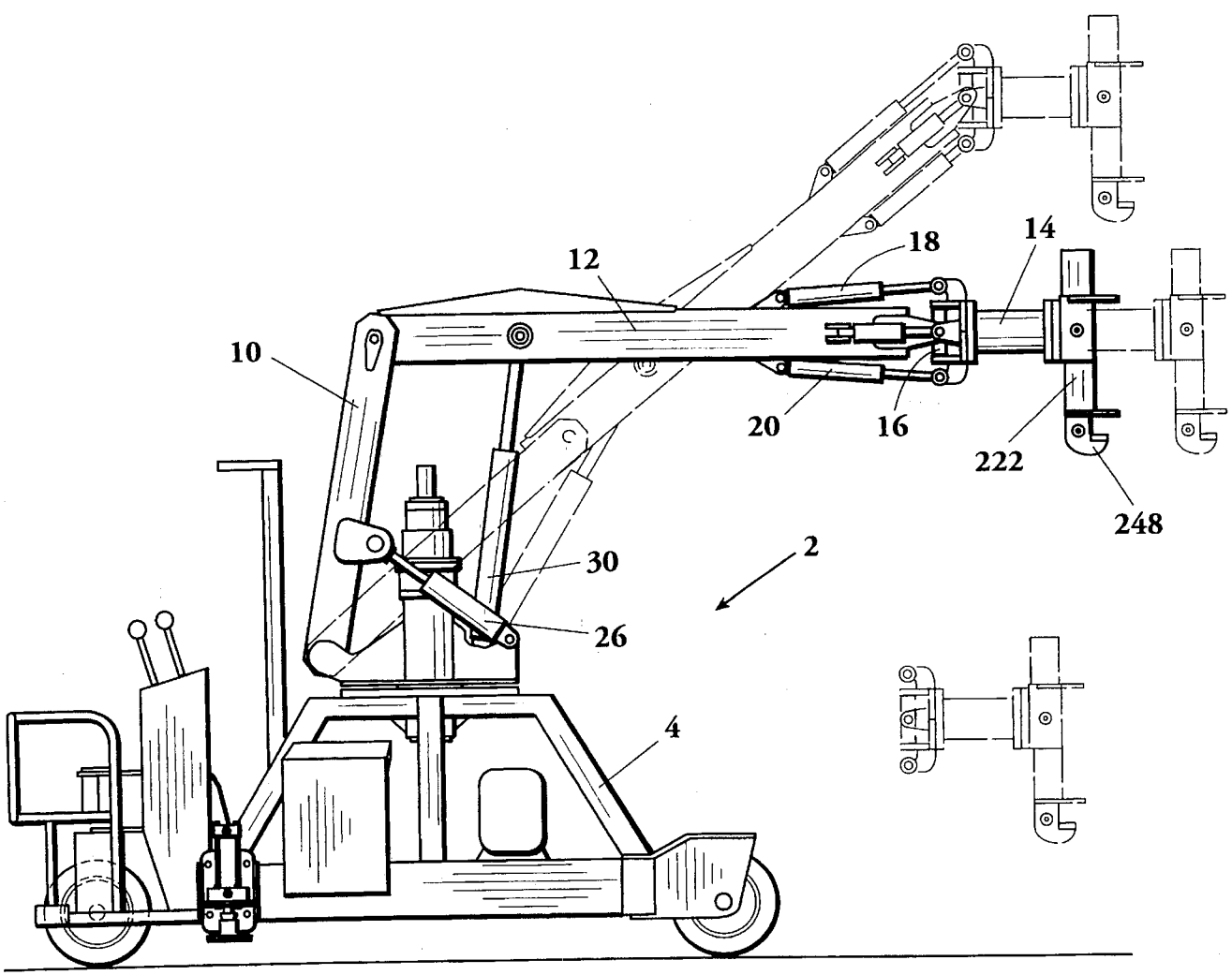
FIG. 5 provides an elevational side view of inventive apparatus 2 and depicts the pivoting operation of boom structures 10 and 12 and head assembly 14 for lifting, lowering, extending, retracting, and otherwise positioning a tool 222.
Figure 7:
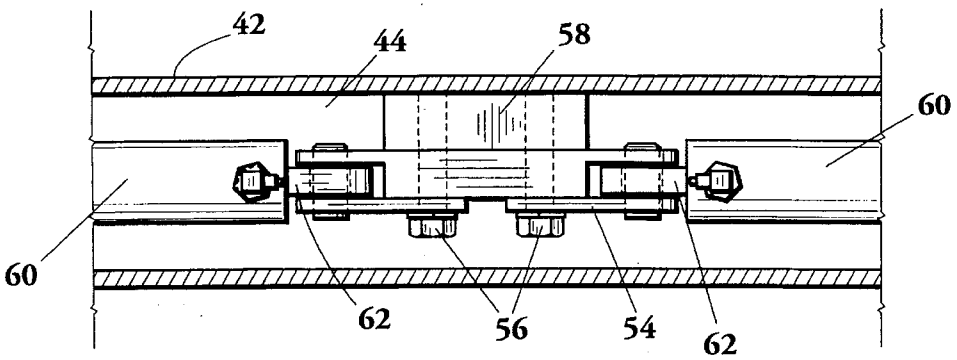
FIG. 7 provides a cutaway top view of the central portion of outrigger assembly 6.
Figure 6:
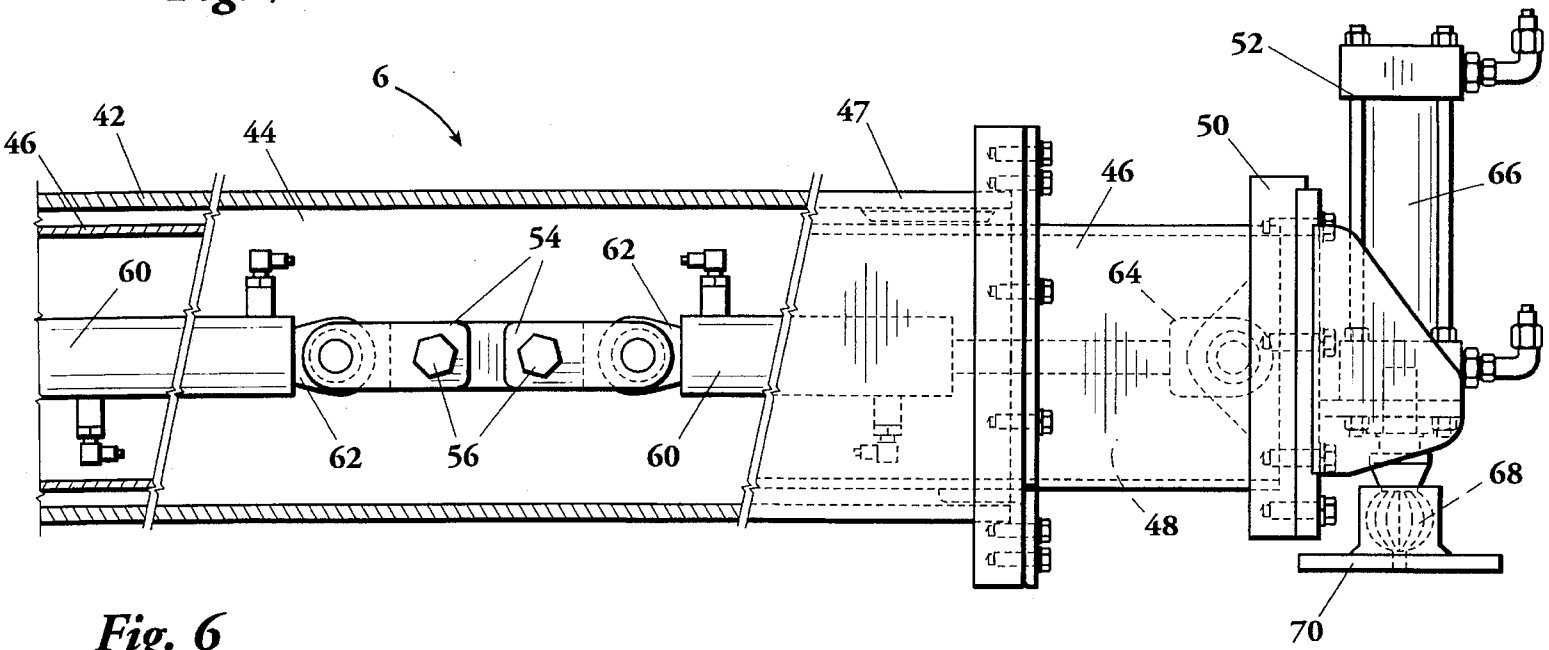
FIG. 6 provides a partially cutaway front view of an outrigger assembly 6 used in inventive apparatus 2.
Figure 8:
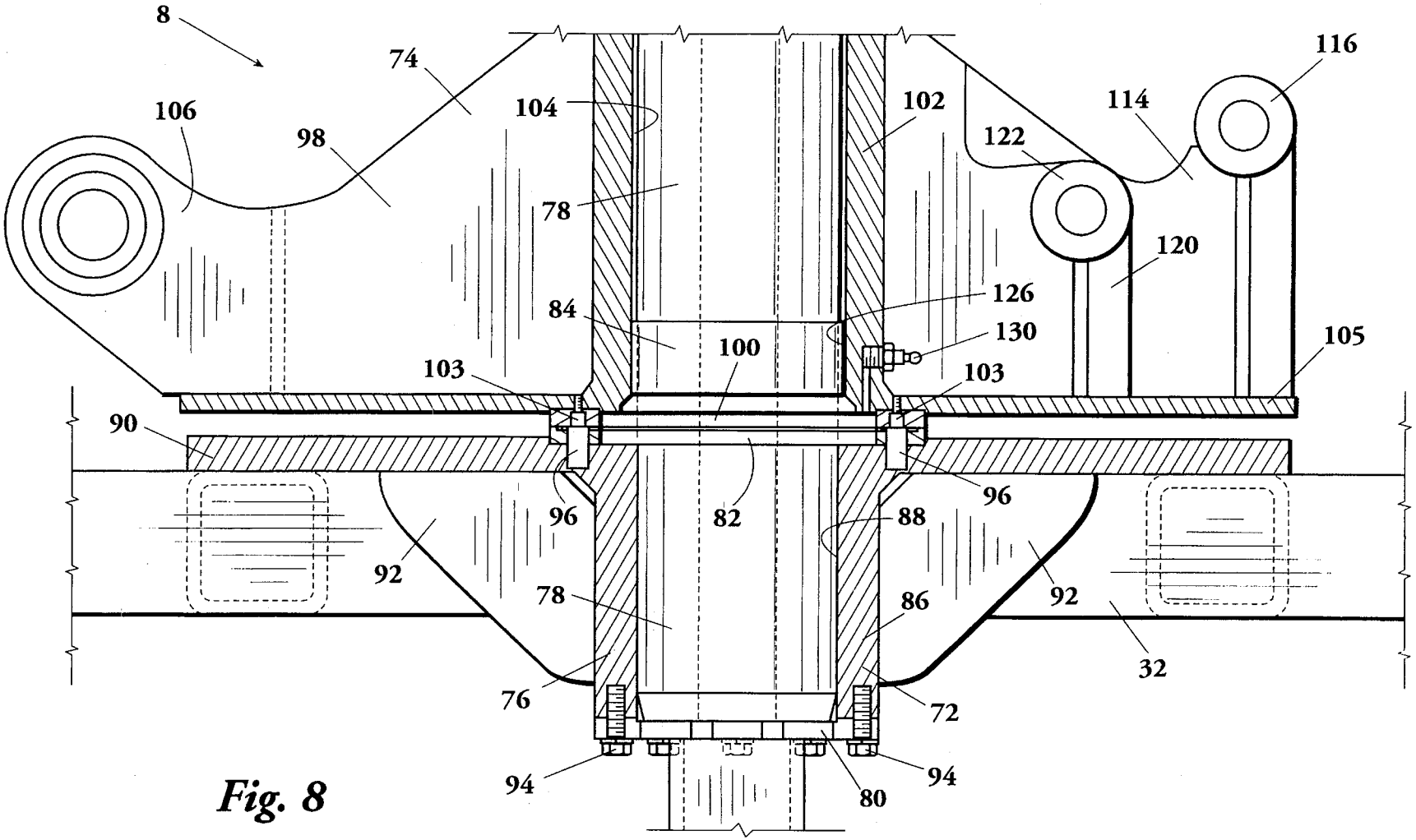
FIG. 8 provides a cutaway elevational side view of the lower portion of turret assembly 8.

In a prototype of inventive apparatus 2 built for testing purposes, turret assembly 8 provided a horizontal rotation angle (i.e., slew), as depicted in FIG. 3, for lateral boom structure 12 of about 270°. Additionally, the operation of hydraulic cylinder assemblies 18 and 20 provided a total head up and down pivot angle of about 90° while the operation of hydraulic cylinder assemblies 22 and 24 provided a total head assembly side to side pivot angle of about 30°. The operation of rotary actuator 214, on the other hand, provided an overall handling tool 222 rotation angle of 180°. Further, as represented in FIG. 5, the boom pivoting operation of hydraulic cylinder assemblies 26 and 28 coupled with the boom pivoting operation of hydraulic cylinder assembly 30 provided a very high degree of maneuverability with respect to the raising, lowering, extension, and retraction of handling tool 222. Moreover, hydraulic cylinder assemblies 18 and 20, hydraulic cylinder assemblies 22 and 24, and rotary actuator 214 were operable in combination to obtain generally any desired handling tool orientation.

Finally, as depicted in FIG. 1, the inventive apparatus preferably includes a remote operator control station 270 for operating all of the boom and head hydraulic functions. As will be understood by those skilled in the art, remote system 270 can be constructed using conventional electro-hydraulic proportional valving. The use of remote system 270 allows optimum operator positioning and visibility while conducting manipulative operations.

Thus, the present invention is well adapted to carry out the objects and attain the ends and advantages mentioned above as well as those inherent therein. While presently preferred embodiments have been described for purposes of this disclosure, numerous changes and modifications will be apparent to those skilled in the art. Such changes and modifications are encompassed within the spirit of this invention as defined by the appended claims.

What is claimed is:

1. An apparatus for handling heavy articles, said apparatus comprising:

a base structure;

a turret rotatably attached to said base structure;

a first boom structure having a first end portion pivotably attached to said turret, said first boom structure also having a distal end portion;

a second boom structure having a first end portion pivotably connected to said distal end portion of said first boom structure, said second boom structure being pivotable with respect to said distal end portion of said first boom structure in only a single plane;

first hydraulic operating means, connected to said turret and to said first boom structure, for pivoting said first boom structure with respect to said turret; and second hydraulic operating means, connected to said turret and to said second boom structure, for pivoting said second boom structure with respect to said first boom structure, wherein said first boom structure is an A-frame structure having a first leg and a second leg, each of said legs being pivotably connected to said turret, and said first hydraulic operating means comprises a first hydraulic cylinder assembly having a first end connected to said turret and a second end connected to said first leg and a second hydraulic cylinder assembly having a first end connected to said turret and a second end connected to said second leg.

2. The apparatus of claim 1 wherein said second hydraulic operating means is a hydraulic cylinder assembly having a first end connected to said turret and a second end connected to said second boom structure.

3. The apparatus of claim 1 wherein said base structure is a mobile, self-propelled base structure.

4. An apparatus for handling heavy articles, said apparatus comprising a base structure;

a turret rotatably attached to said base structure;

a first boom structure having a first end portion pivotably attached to said turret, said first boom structure also having a distal end portion;

a second boom structure having a first end portion pivotably connected to said distal end portion of said first boom structure, said second boom structure being pivotable with respect to said distal end portion of said first boom structure in only a single plane;

first operating means, connected to said turret and to said first boom structure, for pivoting said first boom structure with respect to said turret; and second operating means, connected to said turret and to said second boom structure, for pivoting said second boom structure with respect to said first boom structure, wherein said first boom structure is an A-frame structure having a first leg and a second leg, each of said legs being pivotably connected to said turret, and said first operating means comprises a first cylinder assembly having a first end connected to said turret and a second end connected to said first leg and a second cylinder assembly having a first end connected to said turret and a second end connected to said second leg.

* * * * *

UNITED STATES PATENT AND TRADEMARK OFFICE
CERTIFICATE OF CORRECTION

PATENT NO. : 5,584,646

DATED : December 17, 1996

INVENTOR(S) : Billy M. Lewis; Donald R. Smith; Darin R. Miller

It is certified that error appears in the above-identified patent and that said Letters Patent is hereby corrected as shown below:

ON THE TITLE PAGE:

Left-hand column, Assignee's name, delete "Wiseda Ltd., Baxter Springs, Kans." and substitute — Liebherr Mining Truck, Inc., Newport News, VA -- therefor.

Signed and Sealed this

Twenty-eighth Day of October, 1997

*Attest:*

Bruce Lehman

BRUCE LEHMAN

*Attesting Officer*

*Commissioner of Patents and Trademarks*